US008235373B2

(12) United States Patent
Clarke et al.

(10) Patent No.: US 8,235,373 B2
(45) Date of Patent: Aug. 7, 2012

(54) MULTIPLEX GATHERING DEVICE AND METHOD

(75) Inventors: Thomas Bowen Clarke, Durham, NH (US); Charles Reif Hammond, Durham, NH (US)

(73) Assignee: Goss International Americas, Inc., Durham, NC (US)

( * ) Notice: Subject to any disclaimer, the term of this patent is extended or adjusted under 35 U.S.C. 154(b) by 91 days.

(21) Appl. No.: 12/469,510

(22) Filed: May 20, 2009

(65) Prior Publication Data

US 2010/0019434 A1 Jan. 28, 2010

Related U.S. Application Data

(60) Provisional application No. 61/128,197, filed on May 20, 2008.

(51) Int. Cl.
*B65H 39/043* (2006.01)

(52) U.S. Cl. ..... 270/52.16; 270/52.29; 270/58.29

(58) Field of Classification Search ..... 270/52.16, 270/52.29, 58.23, 58.29
See application file for complete search history.

(56) References Cited

U.S. PATENT DOCUMENTS

| | | | | |
|---|---|---|---|---|
| 4,149,711 | A | 4/1979 | Jackson | 270/57 |
| 4,522,384 | A | 6/1985 | Beckley | 270/54 |
| 4,626,672 | A | 12/1986 | Sapitowicz | 235/480 |
| 4,789,147 | A | 12/1988 | Berger et al. | 270/1.1 |
| 4,949,948 | A | 8/1990 | Petersen | 270/54 |
| 5,013,022 | A | 5/1991 | Graushar | 270/56 |
| 5,050,106 | A | 9/1991 | Yamamoto et al. | 364/550 |
| 5,114,128 | A | 5/1992 | Harris, Jr. et al. | 270/11 |
| 5,174,454 | A | 12/1992 | Parkander | 209/3.3 |
| 5,207,412 | A | 5/1993 | Coons, Jr. et al. | 270/1.1 |
| 5,228,678 | A | 7/1993 | Matsuda et al. | 271/145 |
| 5,276,628 | A | 1/1994 | Schneiderhan | 364/478 |
| 5,317,654 | A | 5/1994 | Perry et al. | 382/61 |
| 5,377,120 | A | 12/1994 | Humes et al. | 364/478 |
| 5,439,209 | A | 8/1995 | Ruenzi | 271/251 |
| 5,445,271 | A | 8/1995 | Kakizaki et al. | 206/459.5 |
| 5,547,175 | A | 8/1996 | Graushar et al. | 270/37 |
| 5,651,798 | A | 7/1997 | Conboy et al. | 29/25.01 |
| 5,678,813 | A * | 10/1997 | Osako et al. | 270/52.16 |
| 5,809,360 | A | 9/1998 | Blake et al. | 396/517 |
| 5,816,773 | A | 10/1998 | Fehringer et al. | 414/789.9 |

(Continued)

FOREIGN PATENT DOCUMENTS

EP 0 386 787 A2 9/1990

(Continued)

*Primary Examiner* — Patrick Mackey
(74) *Attorney, Agent, or Firm* — Davidson, Davidson & Kappel, LLC

(57) ABSTRACT

A multiplex gathering device is provided. The multiplex gathering device includes a first gatherer forming first gathered printed products on a first finishing line, the first finishing line having a trimmer and a second gatherer forming a second gathered printed products on a second finishing line, the second finishing line having a second trimmer. The multiplex gathering device also includes a collecting device which combines the first and second gathered printed products together, a first transporter transporting the first gathered products from the first line to the collecting device and a second transporter transporting the second gathered products from the second line to the collecting device. At least one controller is provided for the multiplex gathering device for controlling the first gatherer and second gatherer and for collecting the first and second printing products in a controlled manner on the collecting device.
A method for a multiplex gathering device is also provided.

19 Claims, 2 Drawing Sheets

U.S. PATENT DOCUMENTS

| | | | | |
|---|---|---|---|---|
| 5,818,724 | A | 10/1998 | Brewster, Jr. et al. | 364/478.08 |
| 5,992,324 | A | 11/1999 | Rombult et al. | 101/477 |
| 6,167,326 | A * | 12/2000 | Graushar et al. | 700/223 |
| 6,192,295 | B1 | 2/2001 | Gunther | 700/225 |
| 6,257,566 | B1 * | 7/2001 | Dooley | 270/52.18 |
| 6,269,609 | B2 | 8/2001 | Graushar et al. | 53/168 |
| 6,347,260 | B1 | 2/2002 | Graushar et al. | 700/223 |
| 6,612,559 | B2 * | 9/2003 | Boss | 270/52.18 |
| 6,682,062 | B2 * | 1/2004 | Graushar et al. | 270/1.02 |
| 7,096,088 | B2 | 8/2006 | Graushar et al. | 700/223 |
| 7,133,851 | B1 * | 11/2006 | Benson | 705/410 |
| 7,221,996 | B2 * | 5/2007 | Benson | 700/221 |
| 7,333,878 | B2 | 2/2008 | Graushar et al. | 700/223 |
| 7,477,964 | B2 | 1/2009 | Graushar et al. | 700/223 |
| 2008/0097643 | A1 | 4/2008 | Graushar et al. | 700/223 |
| 2008/0147233 | A1 | 6/2008 | Graushar et al. | 700/223 |
| 2010/0156019 | A1 * | 6/2010 | Voorhees et al. | 270/1.02 |

FOREIGN PATENT DOCUMENTS

| | | |
|---|---|---|
| EP | 0 914 969 A2 | 11/1998 |
| WO | WO 96/40575 | 12/1996 |

* cited by examiner

MULTIPLEX GATHERING DEVICE AND METHOD

This claims priority to U.S. Provisional 61/128,197 filed on May 20, 2008, and hereby incorporated by reference herein.

The present invention relates generally to post-press equipment for the printing industry.

BACKGROUND

U.S. Pat. Nos. 6,167,326 and 6,347,260, hereby incorporated by reference herein, purportedly disclose methods for combining in zip code order pre-personalized printed items with items that are not pre-personalized. A first mailing list is merged with a second mailing list associated with the items that are not personalized to produce a master mailing list of a desired zip code order.

U.S. Pat. No. 7,096,088, hereby incorporated by reference herein, purportedly discloses a method of combining mail streams in a printing finishing process including the acts of generating a master mailing list having a sequence, forming a first mail stream, forming a second mail stream, and combining the first mail stream and the second mail stream according to the sequence of the master mailing list.

U.S. Pat. Nos. 7,333,878 and 7,477,964, hereby incorporated by reference herein, purportedly disclose methods of combining mail streams where the assembling of printing products occurs on a finishing line, and then a second mail stream is combined on that finishing line.

U.S. Patent Application Publication No. 2008/0147233, hereby incorporated by reference herein, purportedly discloses providing printed products to form a first mail stream on a printing line, providing printed products to form a second mail stream on a printing line, and placing printed product from the second mail stream onto a printed product of the first mail stream to create the combined mail stream in the sequence of a master mailing list.

SUMMARY OF THE INVENTION

Assembling and combining mails streams on a same finishing line requires a lengthy finishing line.

An object of the present invention advantageously provides a co-manufactured mail stream. The co-manufactured mail stream may add flexibility to binding and finishing processes by accommodating varying trim sizes and different sized products.

A further object of the present invention provides collecting two or more printed products from separate gathering and finishing lines on a separate collecting device. The printed products may be stacked or placed next to each other on so the printed products can be stacked and/or mailed together. The use of transport devices and a separate collecting device advantageously permits placement of products together, may shorten finishing line lengths and may permit further processing separate from gathering lines.

The present invention provides a multiplex gathering device comprising:

- a first gatherer forming first gathered printed products on a first finishing line, the first finishing line having a trimmer;
- a second gatherer forming second gathered printed products on a second finishing line, the second finishing line having a second trimmer;
- a collecting device for collecting the first and second gathered printed products together;

- a first transporter transporting the first gathered products from the first line to the collecting device;
- a second transporter transporting the second gathered products from the second line to the collecting device; and
- at least one controller for controlling the first gatherer and second gatherer, the first and second printing products being collected in a controlled manner on the collecting device.

The present invention also provides a method for a multiplex gathering device including the steps of:

- forming first gathered printed products on a first binding line;
- forming second gathered printed products on a second binding line;
- transporting the first gathered products from the first binding line to a collecting device;
- transporting the second gathered products from the binding line to the collecting device; and
- collecting the first and second gathered products in a controlled manner on the collecting device.

The first and second gatherers may be for example, saddle stitchers, perfect binders or other binders. The first and second gatherers may each include a plurality of hoppers, a plurality of pockets or a plurality of receiving locations. The collecting device may include a conveyor, a stacker, a collator, an inserter, a mail table or further finishing devices. Optional hoppers may be provided to deposit additional products on the collecting device in addition to products delivered from first and second transporters. The first and second transporters may be overhead gripper conveyors. Additional gathering devices and additional transporters may also be provided to deliver further products to the collecting device.

BRIEF DESCRIPTION OF THE DRAWING

A preferred embodiment of the present invention will be elucidated with reference to the drawings, in which.

DETAILED DESCRIPTION OF THE PREFERRED EMBODIMENTS

Figure 1:
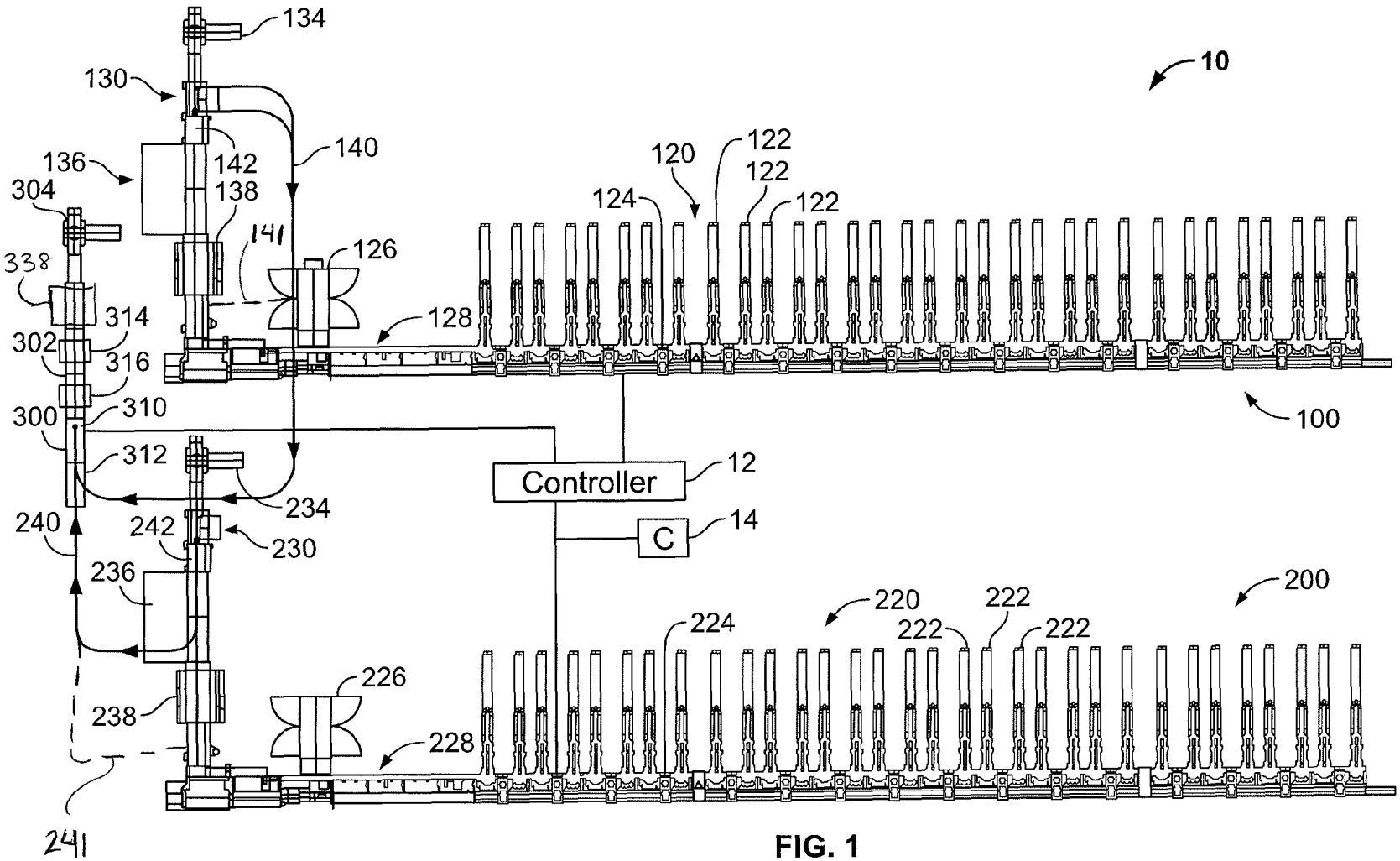
FIG. 1 shows an embodiment of a multiplex gathering device in accordance with the present invention.

FIG. 1 shows a preferred embodiment of a multiplex gathering device 10. The device 10 includes a first gatherer 100 and a second gatherer 200. Gatherer 100 is, for example, a saddle stitcher, and includes a hopper section 120 including a plurality of hoppers 122, a saddle conveyor 124, a stitcher 126 and a binding line 128 connected to a finishing line 130. Hoppers 122 deposit products on saddle conveyor 124 to form desired products. Products are transported to stitcher 126 for stitching. Products may be stitched into, for example, books, magazines, etc. Products formed and stitched on gatherer 100 are then transported downstream to finishing line 130 via binding line 128.

First gatherer 100 is connected to a controller 12. Controller 12 assembles products according to a master list. The master list may be a master mailing list including demographic information or individual recipient information. The master list may include information for assembling multiple titles or versions of the same title or product, for example, to accommodate targeted advertisements. Thus, controller 12 controls hoppers 122, conveyor 124 and stitcher 126 to assemble the desired products. After binding, the products are conveyed to finishing line 130.

Finishing line 130 includes a stacker 134, mail table 136 and a trimmer 138. Products assembled on saddle conveyor 124 are stitched then trimmed before heading downstream to stacker 134 for stacking.

Gatherer 200 may also be a saddle stitcher, perfect binder or other type of gathering device. Gather 200 may be the same type of gatherer as gatherer 100, however, gatherer 200 may also be a different type of gathering device. In the embodiment shown in FIG. 1, gatherer 200 is a saddle stitcher. Gatherer 200 includes a hopper section 220 including a plurality of hoppers 222. Gatherer 200 also includes a saddle conveyor 224, a saddle stitcher 226 for stitching products assembled on conveyor 224 and a binding line 228. Products formed and stitched on gatherer 200 are then transported downstream to a finishing line 230 via binding line 228.

Second gatherer 200 is also connected to a controller 12 and in addition may be connected to a slave controller 14. Controller 12 assembles products on gather 200 according to the master list. Controller 12 may control gatherer 200 via slave controller 14. After binding, the products are conveyed to finishing line 230.

Finishing line 230 includes a stacker 234, mail table 236 and a trimmer 238. Products assembled on saddle conveyor 224 are stitched then trimmed and before heading downstream to a stacker 234 for stacking. Each gatherer 100, 200 may be provided with a respective finishing line 130, 230 in order to provide flexibility during the finishing process, for example, products 142, 242 assembled on gatherers 100, 200 may be trimmed to different sizes by trimmers 138, 238, respectively. Furthermore, providing individual finishing lines 130, 230 allows gatherers 100, 200 to operate individually when desired or needed. When operating individually, controller 12 may control gatherer 100 while controller 14 controls gatherer 200.

Transport devices 140, 240 are provided to work with finishing lines 130, 230 respectively. Transport devices 140, 240 preferably are gripper conveyors and may be, for example, chain, pin or belt conveyors. Each transport device 140, 240 includes a plurality of grippers for gripping printed products that have been assembled and trimmed from finishing lines 130, 230. Grippers pull the stitched and assembled products off finishing lines 130, 230 and deposit the assembled products onto a separate collecting device 300. Grippers may pull the stitched and assembled products off lines 130, 230 at any point after binding, including before or after trimming and before or after stacking.

Collecting device 300 includes a co-mailer 302 and a stacker 304 and may also include a trimmer. Collecting device 300 includes at least one receipt location 310 and may include a further receipt location 312.

In accordance with a preferred embodiment of the present invention, transport devices 140, 240 pull assembled products 142, 242 of first and second gatherers 100, 200 off finishing lines 130, 230 and transport assembled products 142, 242 to separate collecting device 300. Receipt locations 310, 312 receive assembled products from transport devices 140, 240. A combined product 314, as desired by the master mailing list, may include a product 142 and a product 242. A desired product 316, as desired by the master mailing list, may include only one product, product 142 or product 242.

By providing a collecting device 300 separate from finishing lines 130, 230, multiplexing of gatherers 100, 200 can be achieved. By providing finishing lines 130, 230 for gatherers 100, 200, gatherers 100, 200 also can run independently. Products maybe collected and finished into a combined product 314 on collecting device 300 or finished individually, product 316, as desired in a co-manufacturing mode. In addition, gatherers 100, 200 may operate independently and finish products 142, 242 for further transport and mailing via corresponding finishing lines 130, 230.

A product 142 assembled on gatherer 100 stitched by stitcher 126 and trimmed by trimmer 138 is transported by grippers on transport device 140 to a receipt location 310. Product 242, assembled on gatherer 200, stitched by stitcher 226 and trimmed by trimmer 238 is transported by grippers on transport device 240 to receipt location 310 and deposited on top of product 142 to form a composite product 314. Composite product 314 may be wrapped and stacked by collecting device 300 for further transport and delivery.

Alternatively, a transport device 140, 240 may deposit a product 142 or 242 product at a receipt location 310, 312. Product 316, for example, is a product 142 deposited at receipt location 312 by transport conveyor 140. Transport device 240 did not deposit a product 242 at receipt location 312 based on information received from controller 12 via the master mailing list. Thus, product 316 includes product 142 but does not include product 242. Product 316 is finished by collecting device 300 for further transport and delivery. Products 316 may be formed intermittently with products 314.

For example, product 142 may include a general news magazine personalized with a recipient's address information. Product 242 may include a general sports magazine with or without personalized with information. Product 242 maybe combined with product 142 on collecting device 300 as desired and based on, for example, the master mailing list. The master mailing list may include a list of recipients selected to receive both the general news magazine and the general sports magazine. In order to reduce the costs of mailing and increase efficiency, transport device 240 deposits sports magazine product 242 on top of news magazine product 142 at delivery locations 310, 312 forming a combined product 314 which is transported downstream for further processing.

By providing separate finishing lines 130, 230 including trimmers 138, 238, products 142, 242 may be trimmed to different sizes, yet easily combined on collecting device 300 via transport devices 140, 240 for co-manufacturing operations as desired. Thus, the general news magazine and general sports magazine may have different formats and dimensions.

In another preferred embodiment, the master mailing list may include, for example, subscription information. Products 242 may be, for example, subscription renewal cards or notices. Thus, transport device 240 may deposit card products 242 onto news magazine products 142 based on the renewal information included in the master mailing list.

Controller 12 controls first gatherer 100 and second gatherer 200 so that second gathered products 242 may be formed as a function of the first gathered products 142 during a co-manufacturing operation. Controller 12 also controls collecting device 300 and the collection of products 314, 316 collected on collecting device 300. Products 242 from second gatherer 200 may be collected as a function of products 142 from first gatherer 100. As shown in FIG. 1, more than one controller may be provided. A master controller 12 may control first gatherer 100 while a slave controller 14 may control second gatherer 200. During a co-manufacturing operation controller 12 may control first and second gatherers 100, 200 directly or controller 12 may control and/or controller 14.

During a co-mailing operation controller 12 controls the feeding of product from binding line 128 to collecting device 300 and binding line 228 to collecting device 300. Controller 12 maintains proper timing and sequencing between gatherers 100, 200, binding lines 128, 228, finishing lines 130, 230 and transport devices 140, 240 so the products 142, 242, are collected in a controlled manner on collecting device 300.

Transport devices 140, 240 are provided to work with finishing lines 130, 230 respectively. Transport devices 140, 240 preferably are gripper conveyors and may be, for example, chain, pin or belt conveyors. Each transport device 140, 240 includes a plurality of grippers for gripping printed products that have been assembled and trimmed from finishing lines 130, 230. Grippers pull the stitched and assembled products off finishing lines 130, 230 and deposit the assembled products onto a separate collecting device 300. Grippers may pull the stitched and assembled products off lines 130, 230 at any point after binding, including before or after trimming and before or after stacking via, for example, an alternate transport device path 141, 241.

Collecting device 300 includes a co-mailer 302 and a stacker 304 and may also include a trimmer 338. Collecting device 300 includes at least one receipt location 310 and may include a further receipt location 312.

Figure 2:
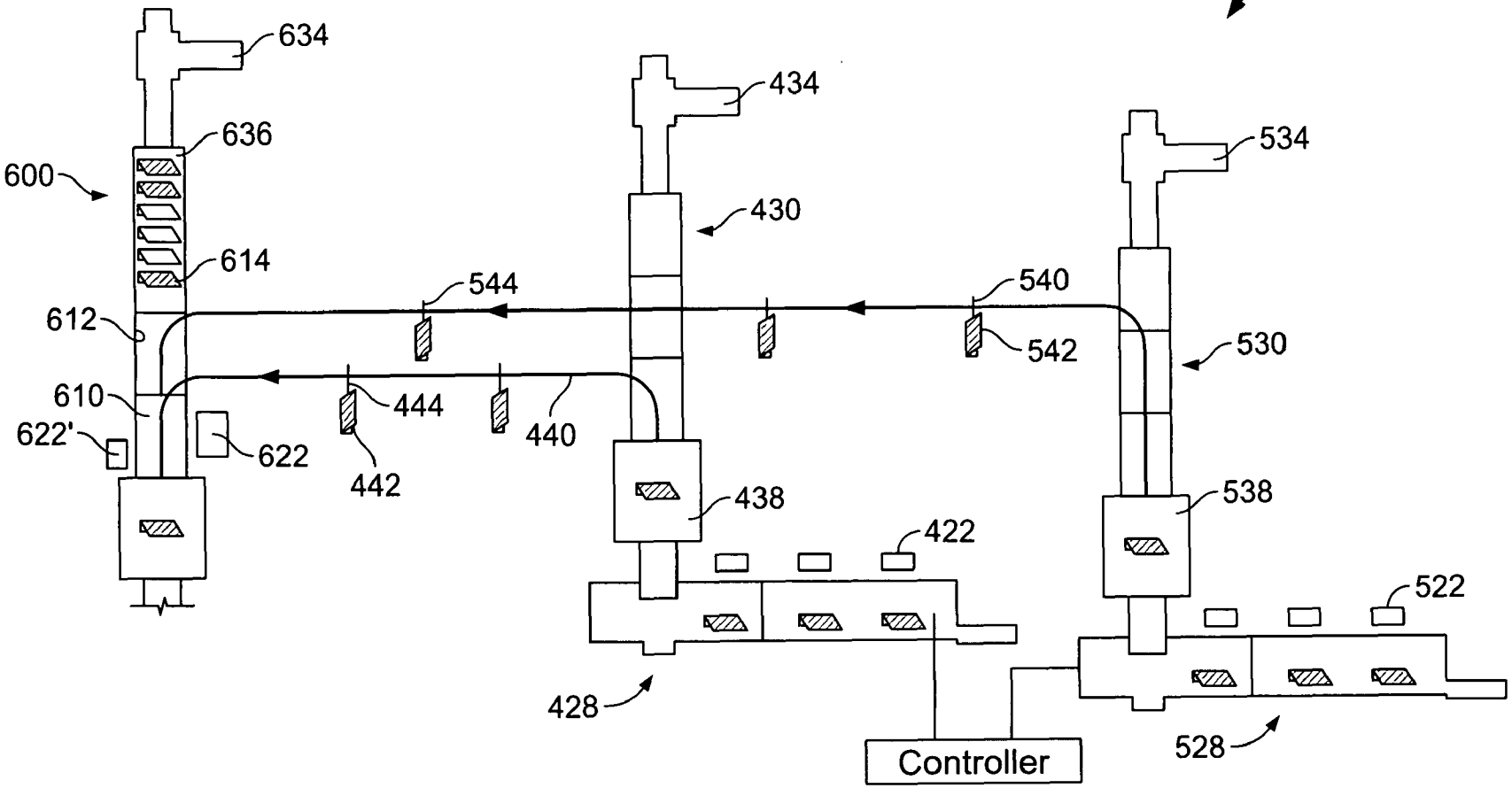
FIG. 2 shows another preferred embodiment of a multiplex gathering device in accordance with the present invention.

FIG. 2 shows another preferred embodiment of a multiplex gathering device 410. Multiplex gathering device 410 includes a first binder 428 that may include a hopper section and a plurality of hoppers 422 for gathering printed products 442. A second binder 528 may also include a hopper section and a plurality of hoppers 522 gathering printed products 542. First and second binders 428, 528 may be saddle stitchers or perfect binders. Trimmers 438, 538 may trim products to different sizes or the same size. A first transport device 440 and a second transport device 540 remove products 442, 542 off of a first finishing line 430 and a second finishing line 530 after products 442, 542 have been trimmed by trimmers 438, 538, respectively. Transport devices 440, 540 each include a plurality of grippers 444, 544 for pulling products off of finishing lines 430, 530. Transport devices 440, 540 may remove products 442, 542 prior to trimming if desired.

Transport devices 440, 540 transport products to a separate collecting device 600. Collecting device 600 includes a plurality of receipt locations 610, 612 for receiving products 442, 542 from first and second transport devices 440, 540. Products 442 may be combined with products 542 on collecting device 600 to form a final product 614 as desired. Collecting device may include a collator, inserter, trimmer, mail table 636, stacker 634 or other finishing devices as desired.

Optional feed hoppers 622, 622' may also be positioned with respect to collecting device 600 to provide additional products to receipt locations 610, 612. Optional feed hoppers 622, 622' may include prebound products or overflow books from binders 428, 528.

Additional binders may also be provided with transport devices to provide further products to collecting device 600. Each binder 428, 528 including any additional binders may operate independently since each binder includes a separate finishing line 430, 530, trimmer 438, 538 and stacker 434, 534 respectively. Thus, binders 428, 528 can operate in multiplex mode with additional binders when co-manufacturing products, or, each binder 428, 258 can operate independently. Binders 428, 528 may also produce bulk mail, non-mail or overflow copies of non-selective content during gaps or other binder production interruptions.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A multiplexed gathering device comprising:

a first gatherer forming first gathered printed products on a first finishing line, the first finishing line having a trimmer;

a second gatherer forming second gathered printed products on a second finishing line, the second finishing line having a second trimmer;

a collecting device for collecting the first and second gathered printed products together;

a first transporter transporting the first gathered products from the first finishing line to the collecting device;

a second transporter transporting the second gathered products from the second finishing line to the collecting device; and at least one controller for controlling the first gatherer and second gatherer, the first and second printing products being collected in a controlled manner on the collecting device.

2. The multiplexed gathering device as recited in claim 1 further comprising an additional hopper located adjacent to the collecting device for providing the collecting device with further products.

3. The multiplexed gathering device as recited in claim 1 further comprising a further gatherer and a further transporter for transporting further products to the collecting device.

4. The multiplexed gathering device as recited in claim 1 wherein the first or second transporters are gripper conveyors.

5. The multiplexed gathering device as recited in claim 1 wherein the first or second transporters are pin conveyors, chain conveyors or belts.

6. The multiplexed gathering device as recited in claim 1 wherein the first transporter or second transporter transport first or second products after the first or second products are trimmed by the first trimmer or second trimmer respectively.

7. The multiplexed gathering device as recited in claim 1 wherein the first transporter or second transporter transport first or second products before the first or second products are trimmed by the first trimmer or second trimmer respectively.

8. The multiplexed gathering device as recited in claim 1 wherein the collecting device includes a trimmer and a stacker for trimming or stacking the first and second products together.

9. The multiplexed gathering device as recited in claim 1 wherein the first gatherer or second gatherer is a saddle conveyor or a perfect binder.

10. The multiplexed gathering device as recited in claim 1 wherein the collecting device receives the second product as a function of the first product so the first and second products can be finished together downstream.

11. The multiplexed gathering device as recited in claim 1 wherein the first finishing line or second finishing line are capable of finishing products not transported by the first or second transporters.

12. The multiplexed gathering device as recited in claim 1 wherein the first products are collected as a function of a master mailing list.

13. The multiplexed gathering device as recited in claim 1 wherein the second products are collected as a function of a master mailing list or a function of the first products.

14. A method for a multiplex gathering device comprising the steps of:

forming first gathered printed products on a first binding line;

forming second gathered printed products on a second binding line;

transporting at least one of the first gathered products from the first binding line to a collecting device;

transporting at least one of the second gathered products from the second binding line to the collecting device; and collecting the first and second gathered products in a controlled manner on the collecting device.

15. The method as recited in claim 14 further comprising the step of trimming the first or second products before the step of transporting the first or second gathered products, respectively.

16. The method as recited in claim 14 further comprising the step of trimming the first or second products after the step of transporting the first or second gathered product using a trimmer on the collecting device.

17. The method as recited in claim 14 wherein the first products are collected in a controlled manner as a function of a master mailing list.

18. The method as recited in claim 14 wherein the second products are collected in a controlled manner as a function of the first products or as a function of a master mailing list.

19. A method for a multiplex gathering device comprising the steps of:

forming first gathered printed products on a first binding line;

forming second gathered printed products on a second binding line;

transporting at least one of the first gathered products from the first binding line to a collecting device;

transporting at least one of the second gathered products from the second binding line to the collecting device;

collecting the first and second gathered products in a controlled manner on the collecting device; and finishing at least one other first product or at least one other second product not transported to the collecting device on a first or second finishing line connected to the first or second binding line, respectively.

* * * * *